US012383011B2

(12) United States Patent
VanValkenburgh et al.

(10) Patent No.: US 12,383,011 B2
(45) Date of Patent: Aug. 12, 2025

(54) HELMET HOLDER

(71) Applicant: Pit Bull Products, Inc., Huntsville, AL (US)

(72) Inventors: Charles VanValkenburgh, Huntsville, AL (US); Kelly R. McMeen, Fayetteville, TN (US); George F. Hoffman, Madison, AL (US)

(73) Assignee: Pit Bull Products, Inc., Huntsville, AL (US)

( * ) Notice: Subject to any disclaimer, the term of this patent is extended or adjusted under 35 U.S.C. 154(b) by 196 days.

(21) Appl. No.: 18/347,736

(22) Filed: Jul. 6, 2023

(65) Prior Publication Data

US 2024/0023662 A1 Jan. 25, 2024

Related U.S. Application Data

(60) Provisional application No. 63/390,493, filed on Jul. 19, 2022.

(51) Int. Cl.
*A42B 3/00* (2006.01)

(52) U.S. Cl.
CPC ..... *A42B 3/006* (2013.01)

(58) Field of Classification Search
CPC ..... A42B 3/006
USPC ..... 206/8, 9
See application file for complete search history.

(56) References Cited

U.S. PATENT DOCUMENTS

| | | | | |
|---|---|---|---|---|
| 9,719,631 | B1 * | 8/2017 | DeLoach, Jr. | A42B 3/006 |
| 11,166,515 | B1 * | 11/2021 | Hajianpour | A42B 3/145 |
| 2017/0000207 | A1 * | 1/2017 | Hajianpour | A42B 3/281 |

* cited by examiner

*Primary Examiner* — Sue A Weaver
(74) *Attorney, Agent, or Firm* — Adam K Sacharoff; Much Shelist, PC

(57) ABSTRACT

The present invention is directed to a helmet holder. The helmet holder allows a helmet to be safely stored in a way that does not compress the internal foam or scratch exterior painted or colored surfaces. It uses four upright, angled tabs to prevent front-to-back and side-to-side motion while allowing the bottom surface of the helmet to rest on somewhat horizontal surfaces. Each of the four tabs has a projection for hooking a bungee net, allowing the helmet to be safely constrained. The holder also has hooks for holding hangable items such as keys. It is expandable to add hooks for smaller items such as gloves and an adapter for hangers to hang jackets or full body suits.

18 Claims, 11 Drawing Sheets

HELMET HOLDER

CROSS REFERENCE TO RELATED INVENTIONS

The present invention claims priority to U.S. Provisional Application 63/390,493 filed Jul. 19, 2022, which is incorporated herein by reference in its entirety.

BACKGROUND OF THE INVENTION

The present invention relates generally to a device to hold a helmet for stationary and mobile applications. More particularly, this invention pertains to a device that safely stows a helmet such as for motorcyclists. It is also capable of stowing jackets or riding suits, keys, glasses, gloves and other gear.

BRIEF SUMMARY OF THE INVENTION

The helmet holder is a modular device that allows a helmet to be safely stored in a way that does not compress the internal foam or scratch exterior painted/colored surfaces. It uses four upright, angled tabs to prevent front-to-back and side-to-side motion while allowing the bottom surface of the helmet to rest on somewhat horizontal surfaces. Each of the four tabs has a projection for hooking a bungee net, allowing the helmet to be safely constrained in the case of the invention being mounted in a trailer or other transportation mode. It has hooks for holding hangable items such as keys or items with a strap or lanyard such as goggles or stop watches and it has holes for inserting items such as glasses. It is expandable to add hooks for smaller items such as gloves and an adapter for hangers to hang jackets or full body suits.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
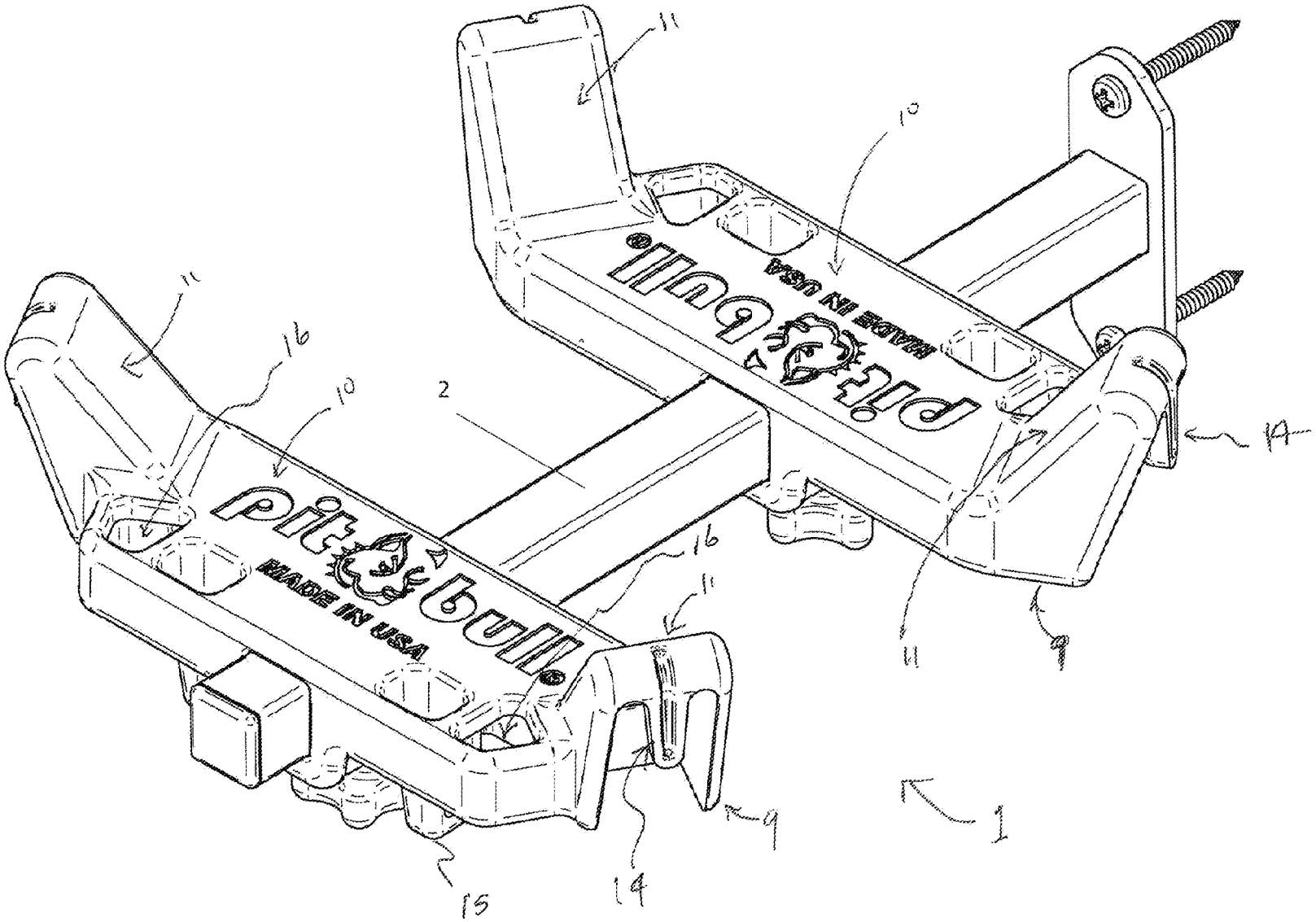
FIG. 1 is primarily a top view illustrating the basic invention showing the horizontal element with the two restraining members in place.
Figure 2:
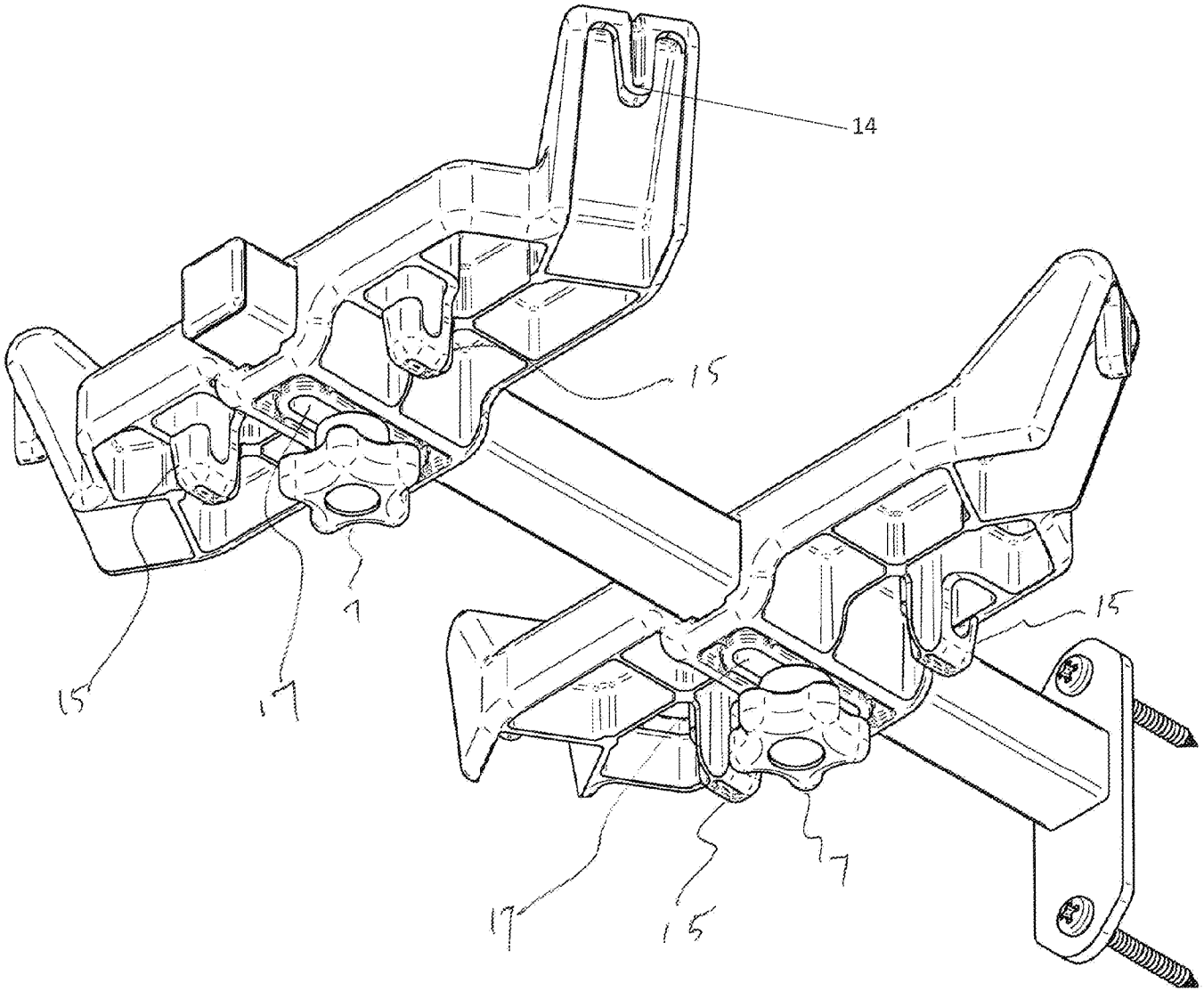
FIG. 2 is primarily a bottom view illustrating the basic invention showing the horizontal element with the two restraining members in place and clearly showing the adjuster knobs.
Figure 3:
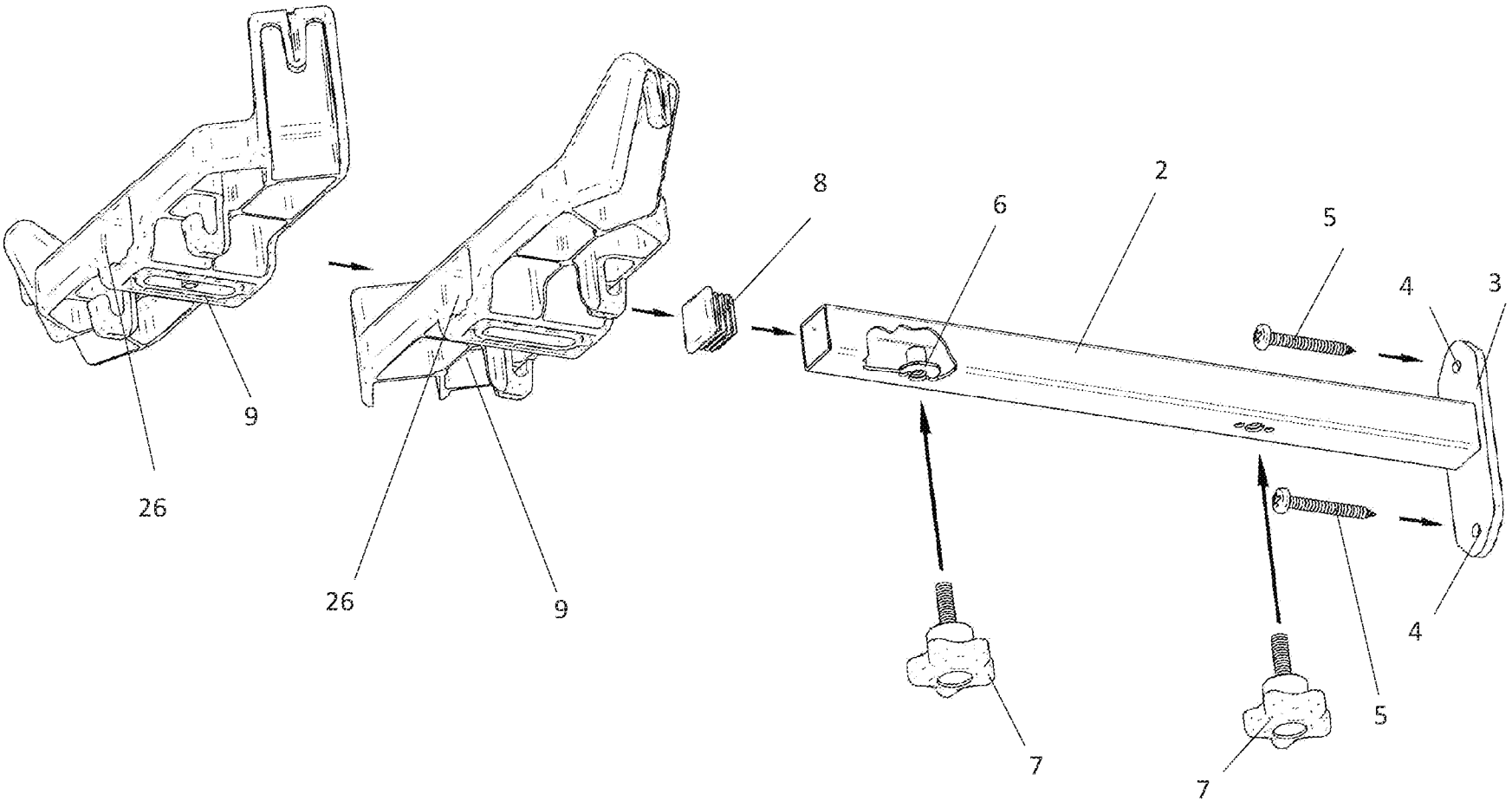
FIG. 3 is an exploded view of the basic invention showing the parts that comprise it.
Figure 4A:
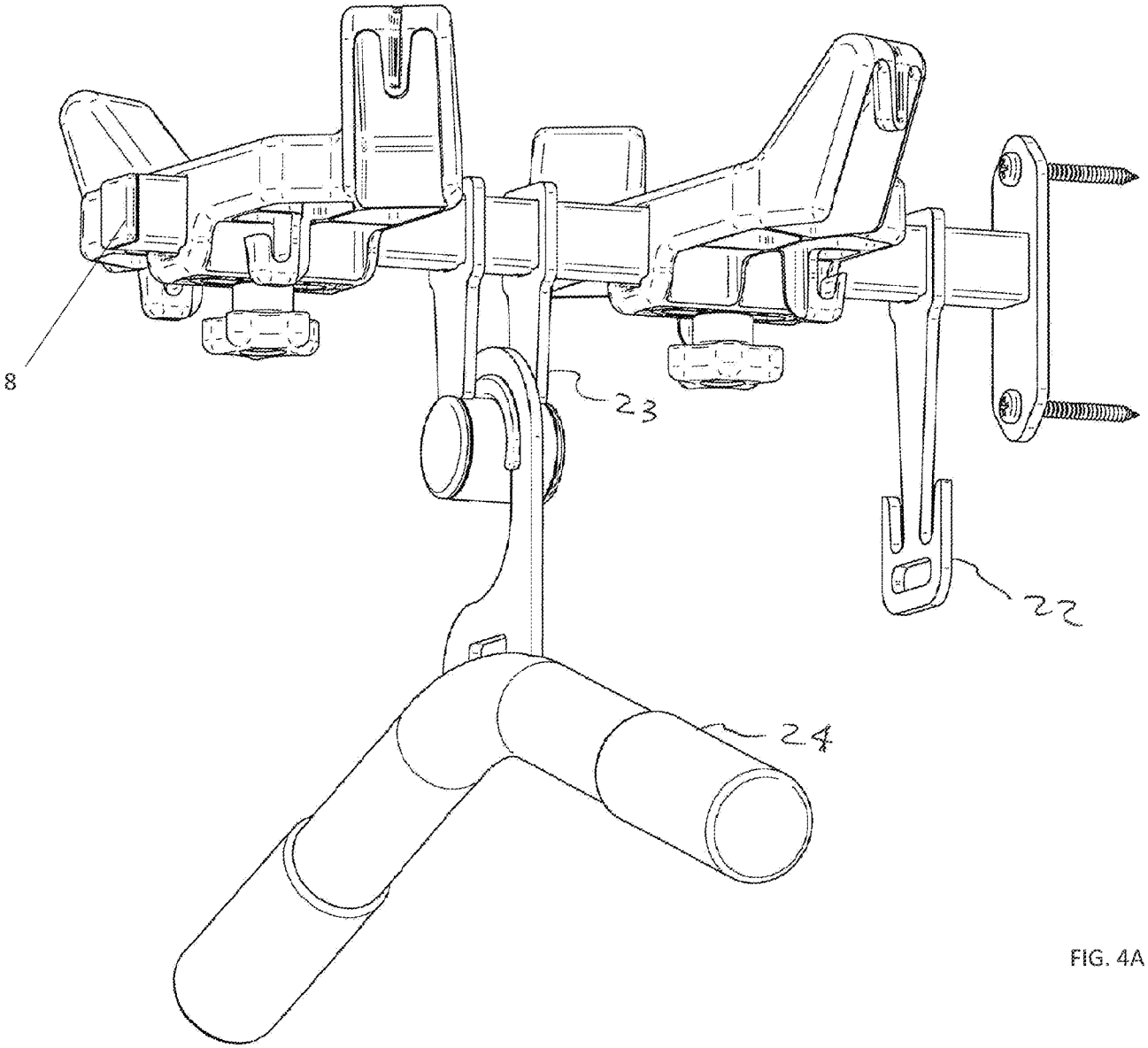
FIG. 4A illustrates the invention with the addition of a provision for holding a hanger adapter with hanger and a hook for holding gloves.
Figure 4B:
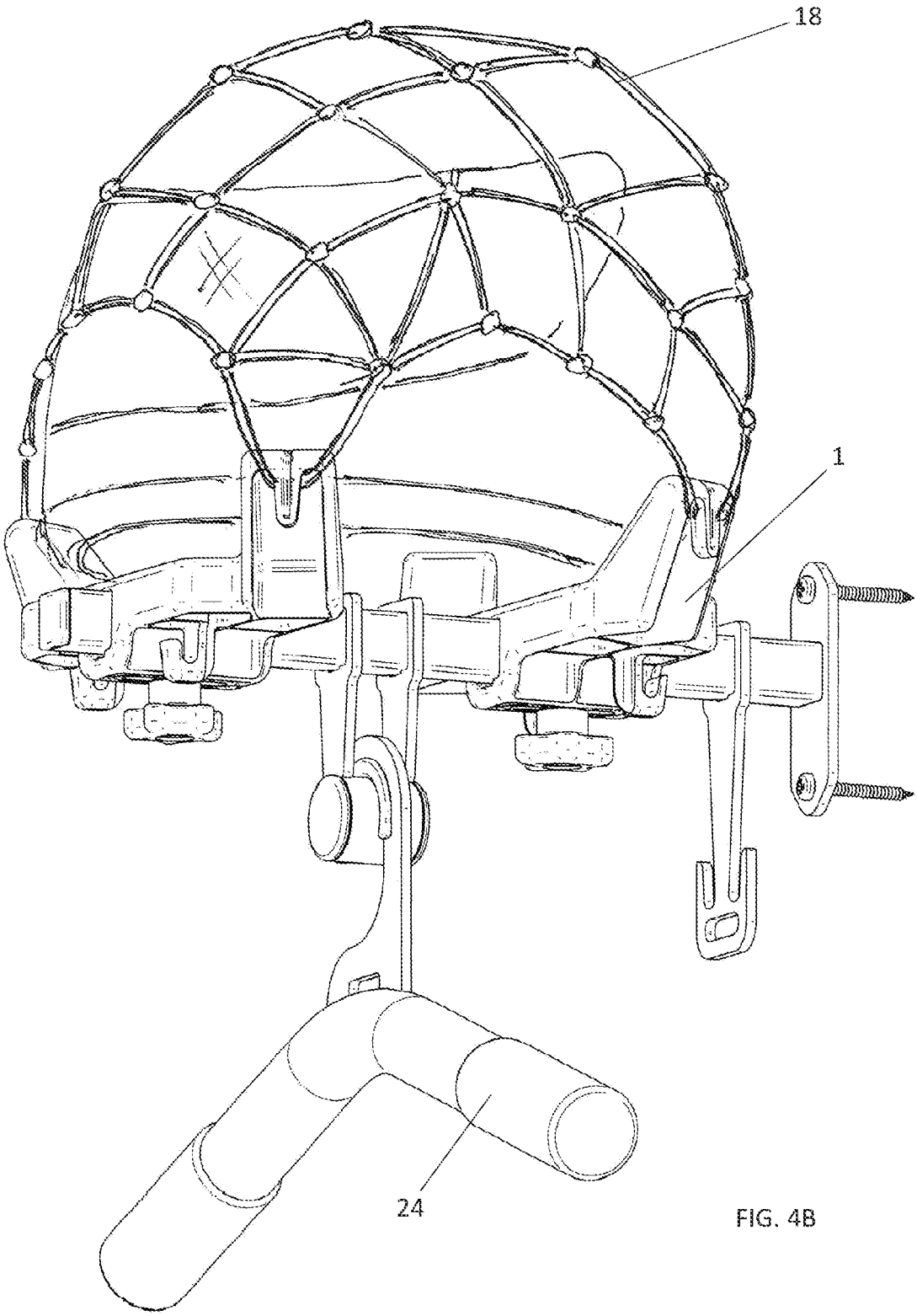
FIG. 4B illustrates a netting over a helmet secured to the helmet holder.
Figure 5:
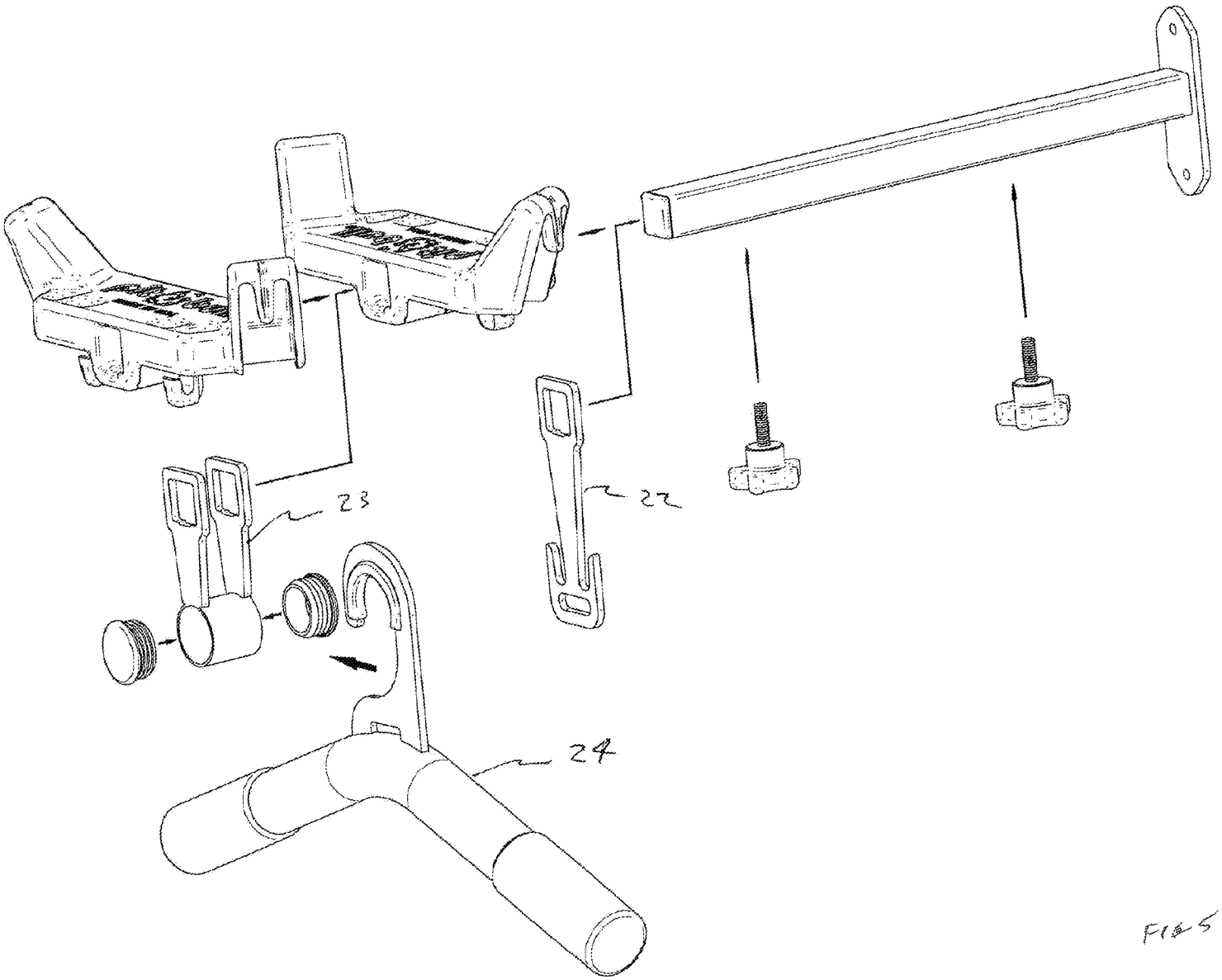
FIG. 5 is an exploded view of the invention including the additional items described in FIG. 4.
Figure 6:
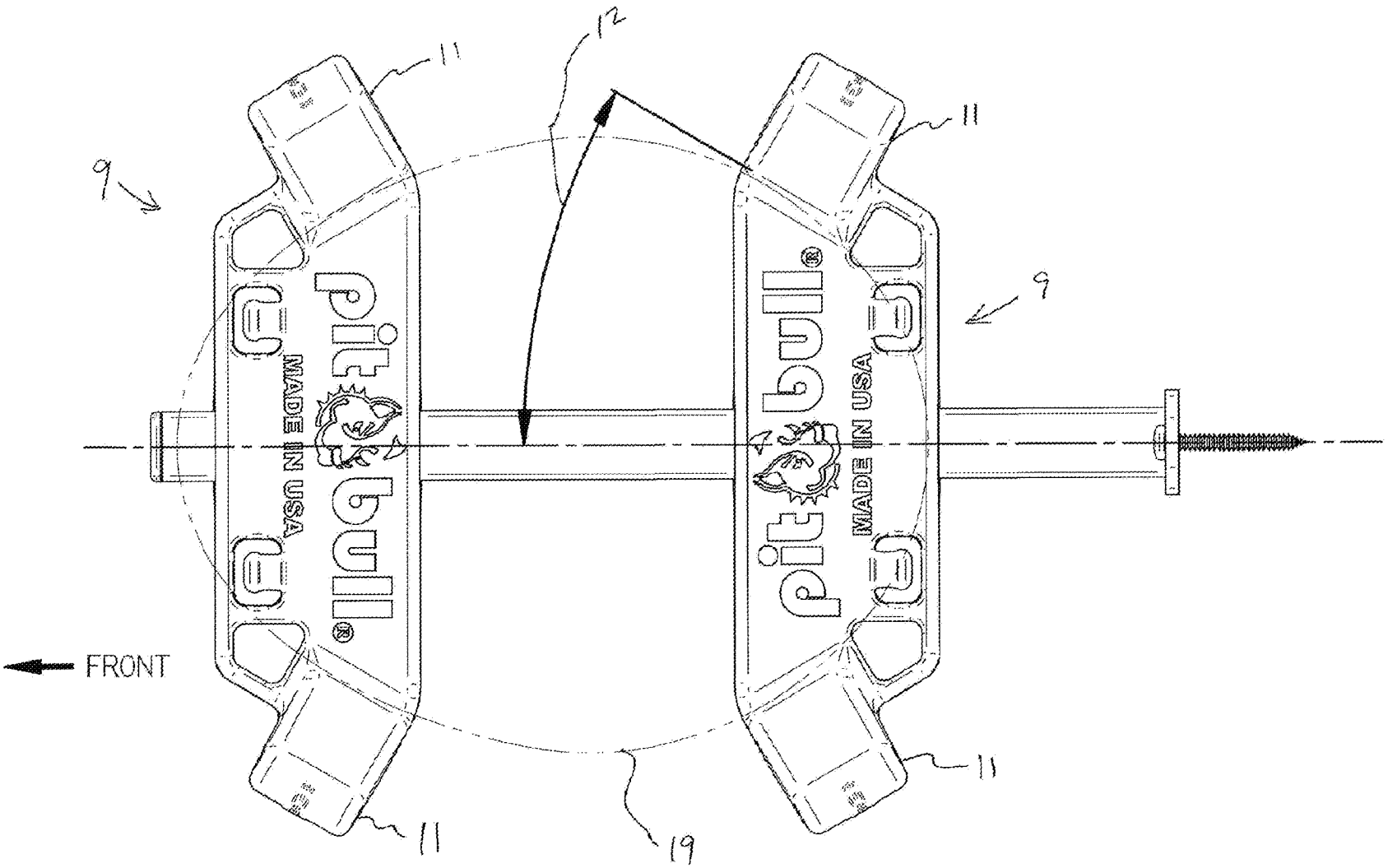
FIG. 6 Illustrates the angle used to restrain the helmet.
Figure 7:
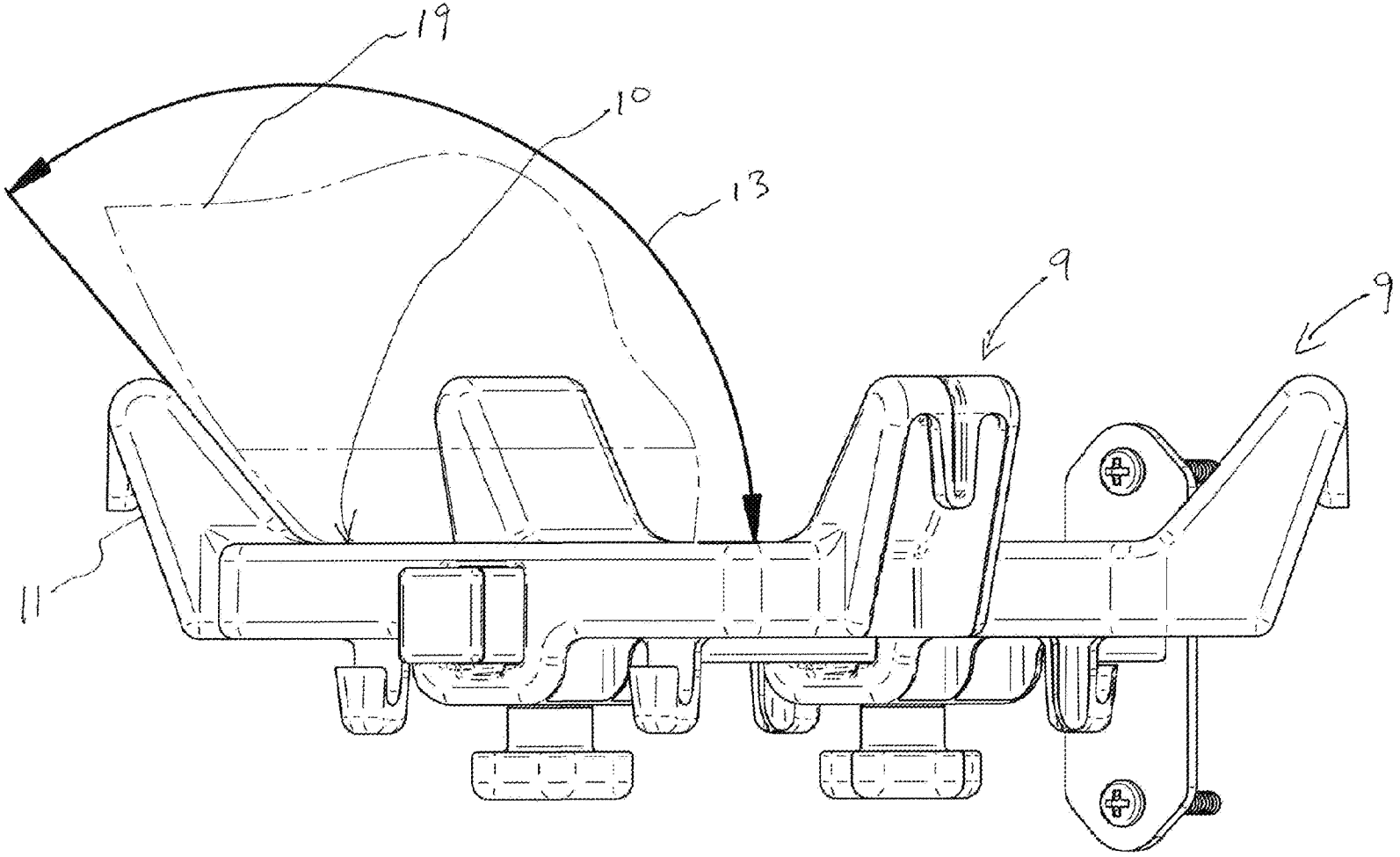
FIG. 7 Illustrates the angle used to prevent contact with painted/colored surfaces of the helmet.
Figure 8:
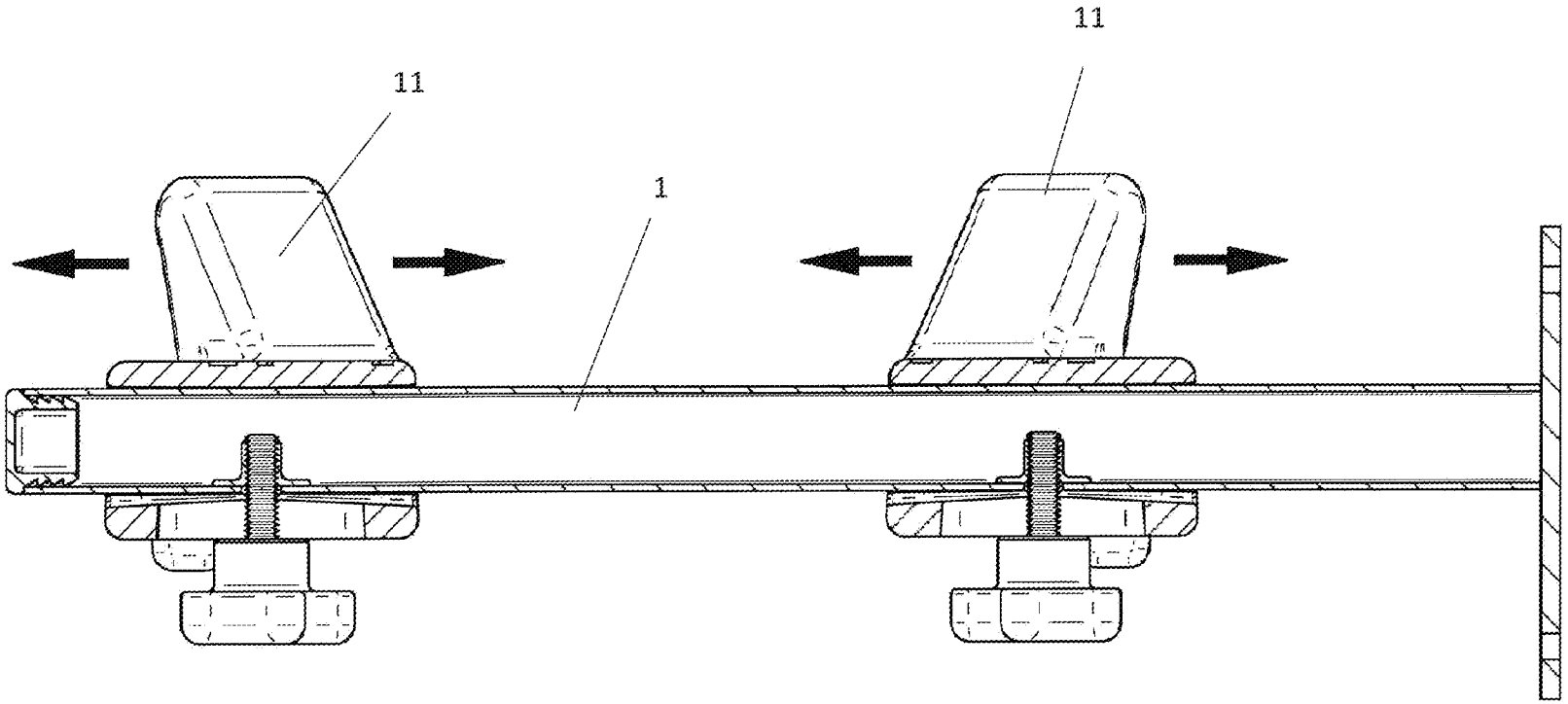
FIG. 8 Illustrates the adjustability of the invention to fit different sizes and configurations of helmets.
Figure 9:
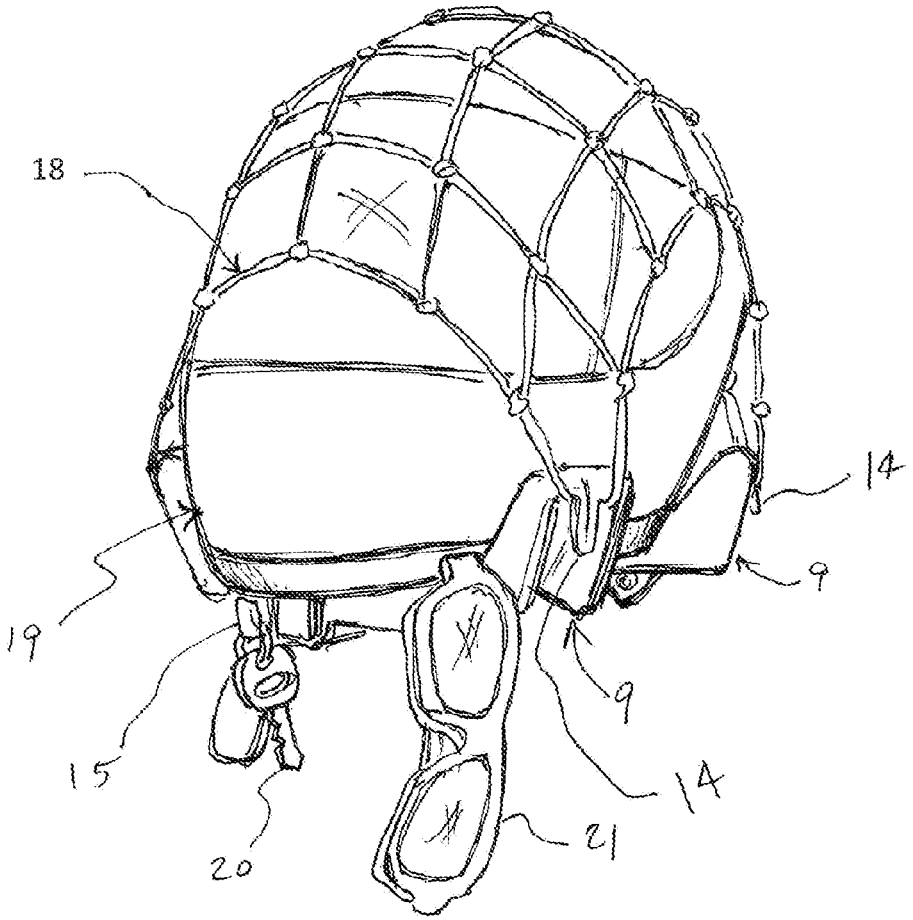
FIG. 9 Illustrates the invention with helmet restrained by bungee net and keys and glasses in place.

Referring now to FIGS. 1-10, the present invention is directed to a helmet holder 1. The helmet holder 1 is a modular device that allows a helmet to be safely stored in a way that does not compress the internal foam or scratch exterior painted/colored surfaces. It uses four upright, angled tabs 11 to prevent front-to-back and side-to-side motion while allowing the bottom surface of the helmet to rest on somewhat horizontal surfaces 10. Each of the four tabs 11 has a projection 14 for hooking a bungee net 18, allowing the helmet to be safely constrained in the case of the invention being mounted in a trailer or other transportation mode. The holder 1 also has hooks 15 for holding hangable items such as keys 20 or items with a strap or lanyard such as goggles or stop watches and it has holes 16 for inserting items such as glasses 21. It is expandable to add hooks 22 for smaller items such as gloves and an adapter 23 for hangers 24 to hang jackets or full body suits.

The base of the device is a square tube 2 that protrudes in a generally horizontal orientation. A mounting plate 3 is permanently fixed perpendicularly to the square tube. The mounting plate 3 has holes 4 for inserting screws 5 for mounting to a generally vertical surface such as a wall in a trailer or garage. The square tube 2 has two female threaded inserts 6 permanently attached from inside the tube and oriented toward the bottom surface of the tube to receive threaded knobs 7. The square tube is closed off with a plastic cap 8.

The supporting/restraining members 9 are the direct interfaces with the helmet. They are identical pieces mounted opposite each other as a mirror image. They each have square holes 26 that correspond to the generally horizontal square tube. The square tube-to-square hole inherently prevent rotation. Each supporting/restraining members 9 has a flat surface 10 between the pair of tabs 11 that the bottom edge of the helmet rests on. The two tabs 11 are situated at a first angle 12 with respect to the centerline of the square tube 2. The purpose of first angle 12 is to prevent both front-to-back and side-to-side movement of the helmet. The tabs 11 are also configured on a second angle 13 with respect to horizontal so as to restrain the helmet front-to-back and side-to-side without contacting the painted/colored surface of the helmet.

To accommodate different sizes and configurations of helmets, the supporting/restraining members 9 can be moved frontward or backward with respect to each other. This is facilitated with slots 17 to allow the supporting/restraining members 9 to move front to back and threaded knobs 7 to lock them in place once the desired position is achieved.

For stationary applications, gravity alone holds the helmet in place. If the invention is used to transport a helmet in a motorized vehicle, trailer or other means of mobility, it is necessary to restrain the helmet without relying on gravity alone. To achieve this, the helmet is held to the supporting/restraining members 9 with a bungee net 18 that hooks onto the finger-like projections 14 of the four tabs 9. The bungee net accommodates different sizes and configurations of helmets by the fact that a) it is elastic, and b) it is made on a square grid whereby a tighter fit can be achieved by stretching to the next square. For example, the bungee net might be hooked to the finger-like projections by the outer perimeter of the bungee net for larger helmets while the more inner squares of the bungee net might be hooked to hold a smaller helmet. There are a couple of other ways to restrain the helmet for transport. These include: a) The helmet bag that is provided with the purchase of many helmets can be pulled over the helmet and cinched under the bottom of the supporting/restraining members, and b) The chin strap of the helmet can be secured under the horizontal square tube.

There are two hooks 15 on the bottom of each supporting/restraining member. These are ideal for retaining keys on a key ring but are also suited to holding items with a lanyard such stop watches, meters or cameras.

Two holes 16 penetrate the somewhat horizontal surface of each supporting/restraining member. These are tailored for allowing insertion of sunglasses, safety glasses and some goggles.

One or more hooks 22 can be installed on the generally square tube. With a square hole that corresponds to the square tube, the hook can be slid into place and held captive by one of the supporting/restraining members. The hooks are capable of holding gloves, goggles or any item with a reasonably-sized strap.

An adapter 23 can be slid into place in the same fashion as the hook described above. This is capable of receiving a hanger 24 for holding jackets, vests or full body suits such as a flight suit or racing suit.

Figure 10:
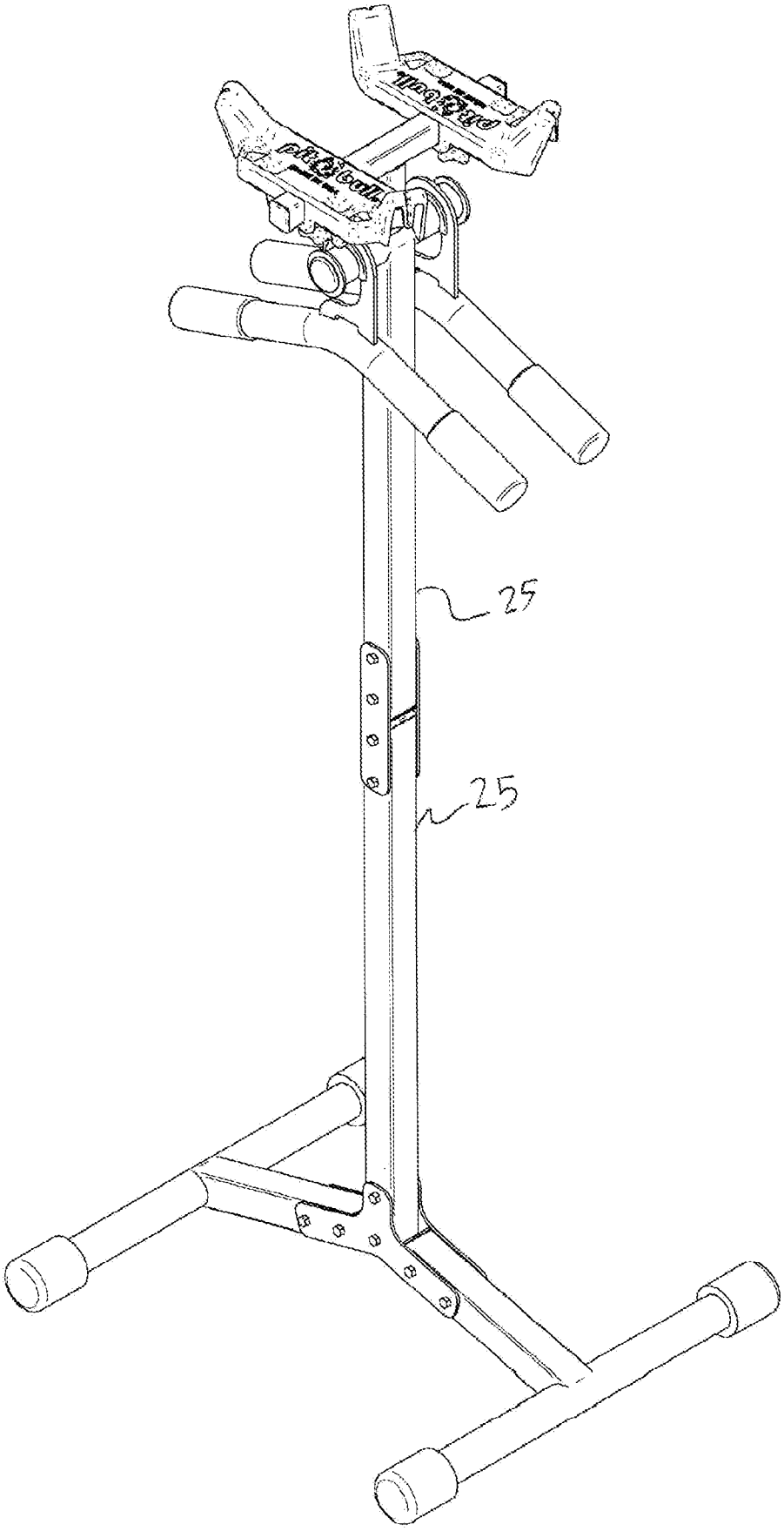
FIG. 10 Illustrates the invention configured to rest on the floor with provisions for hangers.

The invention can be permanently attached to the wall of a trailer, transport vehicle, garage, closet or any somewhat vertical surface using screws 5. It can also be attached to a relatively flat surface or to a commercially available modular mount such as aircraft seat track or E-track. It can alternatively be configured with a vertical member 25, as shown in FIG. 10, that allows it to rest, or be attached to a table top or floor.

Since it is capable of safely restraining a helmet for transport, it can be mounted to a motorcycle to allow the rider to transport an extra helmet.

The invention uniquely and safely restrains a helmet by allowing it to rest on flat surfaces and be contained in static environments by the angled tabs and restrained for motion with the bungee net. The invention is set apart from devices that penetrate the inside of the helmet with its inherent ability to prevent the helmet from rocking and without crushing the foam interior.

The device is modular in two senses, as described here: 1) It can be equipped with different adapters in single or multiple quantities to allow the device to store items such as jackets, gloves, clothing or safety gear; and 2) Since the restraining members are removable, they can be replaced with one or more restraining members that install in the same fashion but differ in shape, size, height and number or shape of upright tabs. The length of the horizontal support can be varied as needed. Variations of configuration could be designated for different uses such as motorcycle touring, motorcycle road racing, motorcycle dirt riding, rock climbing, bicycling, football teams, baseball teams, hockey teams, military or tactical groups, firefighting.

In one or more embodiments of the present invention there is provided a helmet holder 1 that includes: (a) a tube 2 protruding in a substantially horizontal orientation, and wherein the tube includes a bottom surface with a pair of threaded mounting openings 6 spaced apart from each other; (b) a mounting plate 3 affixed to one end of the tube; (c) a pair of supporting and retraining members 9 adjustably secured onto the tube 2, the pair of supporting and retraining members 9 spaced apart from each other on the tube, and wherein each of the supporting and retraining members includes: (i) a substantially flat horizontal base 10 extending perpendicular to the tube, the base having two opposing ends, each end having a tab 11 having an angled face configured to rest on the outside of a portion of a helmet and the angled face further configured to prevent front-to-back and prevent side-to-side movement of a helmet when positioned between the tabs, and (ii) a bottom portion defined under the tube 2, the bottom portion having a slot 17 oriented along a longitudinal axis of the tube; and (d) a pair of threaded knobs 7 separately positioned through the slot and into the pair of threaded mounting openings 6 such that when tightened the pair of supporting and retraining members are locked in positioned to hold a helmet between the tabs.

The helmet holder may further include holes 4 on the mounting plate 3 to receive mounting screws 5 to secure the mounting plate to a vertical surface.

The helmet holder may further be defined such that wherein the pair of threaded mounting openings 6 is further configured as a pair of openings and each opening includes a female threaded insert positioned internally to the tube and positioned over each one of the pair of openings.

The helmet holder may further be defined to have a squared shaped tube to prevent rotation and further includes an end cap. In addition, each of the supporting and retraining members may further include a bore positioned under the flat horizontal base, the bore being sized to receive the tube.

The helmet holder may further define the angled face of each tab at a first angle defined to a centerline of the tube to prevent front-to-back and prevent side-to-side movement of a helmet when positioned between the tabs, and the angled face of each tab may further be configured at a second angle defined to the longitudinal axis of the tube. In addition, the first angle may be less than 90 degrees and the second angle may be greater than 90 degrees.

The helmet holder may further define each tab to include a finger projection on the side opposite the angled face, and a netting configured for positioning over a helmet and hooked into the finger projections on each tab.

The helmet holder may further define the bottom portion of each one of the pair of supporting and retraining members to include at least one downwardly projecting hook configured to hold an item. In addition, each one of the pair of supporting and retraining members may include apertures bored through the flat horizontal base to the bottom portion, the apertures configured to hold an item.

We claim:

1. A helmet holder comprising:

a tube protruding in a substantially horizontal orientation, and wherein the tube includes a bottom surface with a pair of threaded mounting openings spaced apart from each other, a mounting plate affixed to one end of the tube;

a pair of supporting and retraining members adjustably secured onto the tube, the pair of supporting and retraining members spaced apart from each other on the tube, and wherein each of the supporting and retraining members includes:

(a) a substantially flat horizontal base extending perpendicular to the tube, the base having two opposing ends, each end having an angled tab with a surface configured to face at an angle inwardly towards a longitudinal axis of the tube such that the surface of the angled tab is configured to rest on the outside of a portion of a helmet and the angled tab further configured to prevent front-to-back and prevent side-to-side movement of a helmet when positioned between the tabs, and (b) a bottom portion defined under the tube, the bottom portion having a slot oriented along a longitudinal axis of the tube; and a pair of threaded knobs separately positioned through the slot and into the pair of threaded mounting openings such that when tightened the pair of supporting and retraining members are locked in positioned to hold a helmet between the tabs.

2. The helmet holder of claim 1, wherein the mounting plate includes holes to receive mounting screws to secure the mounting plate to a vertical surface.

3. The helmet holder of claim 1, wherein the pair of threaded mounting openings is further configured as a pair of openings and each opening includes a female threaded insert positioned internally to the tube and positioned over each one of the pair of openings.

4. The helmet holder of claim 3, wherein the tube is squared shaped to prevent rotation and further includes an end cap.

5. The helmet holder of claim 4, wherein each of the supporting and retraining members further includes a bore positioned under the flat horizontal base, the bore being sized to receive the tube.

6. The helmet holder of claim 1, wherein the angled tab is configured at a first angle defined to a centerline of the tube to prevent front-to-back and prevent side-to-side movement of a helmet when positioned between the tabs, and the angled face of each tab is further configured at a second angle defined to the longitudinal axis of the tube.

7. The helmet holder of claim 6, wherein the first angle is less than 90 degrees and the second angle is greater than 90 degrees.

8. The helmet holder of claim 6, wherein the each tab includes a finger projection on the side opposite the angled face, and a netting is configured for positioning over a helmet and hooked into the finger projections on each tab.

9. The helmet holder of claim 8, wherein the bottom portion of each one of the pair of supporting and retraining members includes at least one downwardly projecting hook configured to hold an item.

10. The helmet holder of claim 9, wherein each one of the pair of supporting and retraining members includes apertures bored through the flat horizontal base to the bottom portion, the apertures configured to hold an item.

11. A helmet holder comprising:

a squared shaped tube protruding in a substantially horizontal orientation, and wherein the tube includes a bottom surface with a pair of threaded mounting openings spaced apart from each other, a mounting plate affixed to one end of the tube;

a pair of supporting and retraining members, each one of the pair of supporting and retraining members being adjustably secured onto the tube by having a bore sized to receive the tube, the pair of supporting and retraining members spaced apart from each other on the tube, and wherein each of the supporting and retraining members includes:

(a) a substantially flat horizontal base extending perpendicular to the tube, the base having two opposing ends, each end having a tab having an angled face configured to rest on the outside of a portion of a helmet and wherein the angled face of each tab is configured at a first angle defined to a centerline of the tube, and the angled face of each tab is further configured at a second angle defined to the longitudinal axis of the tube, wherein the angled face is defined to prevent front-to-back and prevent side-to-side movement of a helmet when positioned between the tabs;

(b) a bottom portion defined under the tube, the bottom portion having a slot oriented along a longitudinal axis of the tube; and a pair of threaded knobs separately positioned through the slot and into the pair of threaded mounting openings such that when tightened the pair of supporting and retraining members are locked in positioned to hold a helmet between the tabs.

12. The helmet holder of claim 11, wherein the mounting plate includes holes to receive mounting screws to secure the mounting plate to a vertical surface.

13. The helmet holder of claim 11, wherein the pair of threaded mounting openings is further configured as a pair of openings and each opening includes a female threaded insert positioned internally to the tube and positioned over each one of the pair of openings.

14. The helmet holder of claim 11, wherein the first angle is less than 90 degrees and the second angle is greater than 90 degrees.

15. The helmet holder of claim 11, wherein the each tab includes a finger projection on the side opposite the angled face, and a netting is configured for positioning over a helmet and hooked into the finger projections on each tab.

16. The helmet holder of claim 11, wherein the bottom portion of each one of the pair of supporting and retraining members includes at least one downwardly projecting hook configured to hold an item.

17. The helmet holder of claim 11, wherein each one of the pair of supporting and retraining members includes apertures bored through the flat horizontal base to the bottom portion, the apertures configured to hold an item.

18. A helmet holder comprising:

a tube protruding in a substantially horizontal orientation, and wherein the tube includes a bottom surface with a pair of threaded mounting openings spaced apart from each other, a pair of supporting and retraining members adjustably secured onto the tube, the pair of supporting and retraining members spaced apart from each other on the tube, and wherein each of the supporting and retraining members includes:

(a) a substantially flat horizontal base extending perpendicular to the tube, the base having two opposing ends, each end having a tab having an angled face configured to rest on the outside of a portion of a helmet and the angled face further configured at an angle defined towards a centerline of the tube to prevent front-to-back and prevent side-to-side movement of a helmet when positioned between the tabs, and (b) a bottom portion defined under the tube, the bottom portion having a slot oriented along a longitudinal axis of the tube;

a pair of threaded knobs separately positioned through the slot and into the pair of threaded mounting openings such that when tightened the pair of supporting and retraining members are locked in positioned to hold a helmet between the tabs; and a vertical pole extending downwardly from the tube and secured to a surface base member configured to rest on a floor surface and configured to support the helmet holder horizontally above the floor surface.

* * * * *